United States Patent [19]

Schuette et al.

[11] 4,098,008

[45] Jul. 4, 1978

[54] DRY KILN HAVING BIDIRECTIONAL AIR FLOW WITH UNIDIRECTIONAL FAN ROTATION

[75] Inventors: Henry W. Schuette, Tigard, Oreg.; Martin N. Nye, Vancouver, Wash.

[73] Assignee: Wellons, Inc., Sherwood, Oreg.

[21] Appl. No.: 740,119

[22] Filed: Nov. 8, 1976

[51] Int. Cl.[2] ..... F26B 21/06

[52] U.S. Cl. ..... 34/191; 34/216; 34/225

[58] Field of Search ..... 34/191, 184–187, 34/201, 209, 216, 217, 218, 225, 236

[56] References Cited

U.S. PATENT DOCUMENTS

| | | | |
|---|---|---|---|
| 1,903,063 | 3/1933 | Olsson et al. | 34/191 |
| 2,032,628 | 3/1936 | Nelson et al. | 34/191 |
| 2,055,073 | 9/1936 | Ferre | 34/191 |
| 3,065,553 | 11/1962 | Olin | 34/191 |

*Primary Examiner*—Kenneth W. Sprague
*Assistant Examiner*—James C. Yeung
*Attorney, Agent, or Firm*—Klarquist, Sparkman, Campbell, Leigh, Hall & Whinston

[57] ABSTRACT

In a dry kiln, a plurality of in-tandem air control compartments and a fan between each pair of adjacent compartments. The fans are rotated in one direction only. The compartments have lateral air flow ports in which air valves are mounted. The fans are of opposite pitch and the valves are so alternately operated that although the fans blow the air unidirectionally, the air can be controlled to flow in one direction through the drying chamber of the kiln, or optionally in the opposite direction, for uniform drying purposes.

5 Claims, 7 Drawing Figures

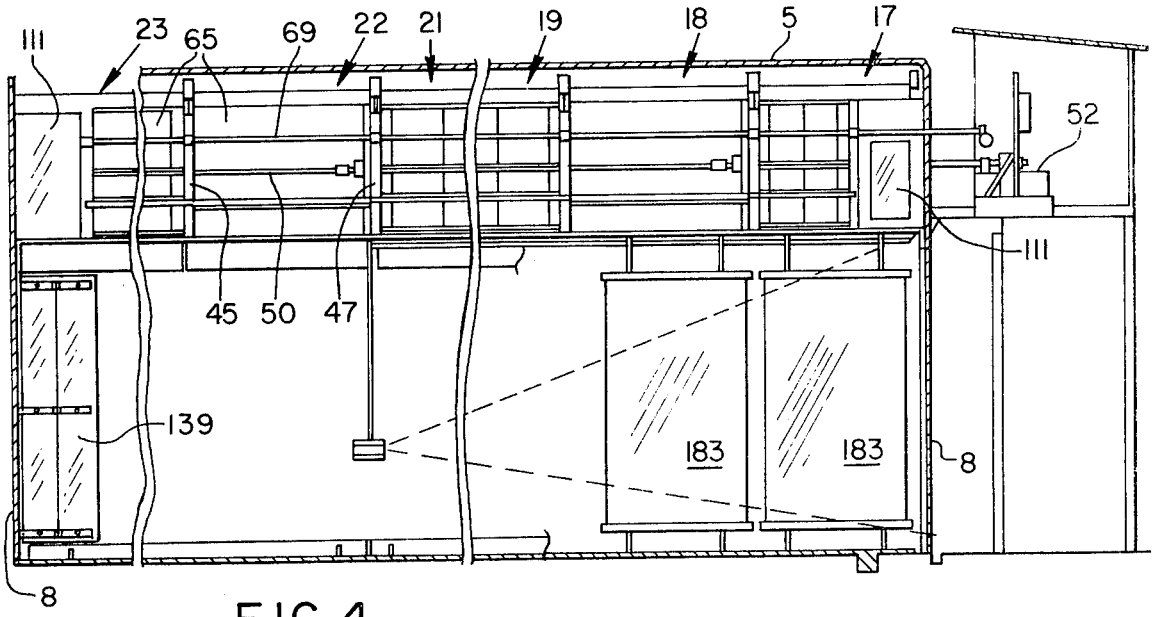
FIG. 4
FIG. 5
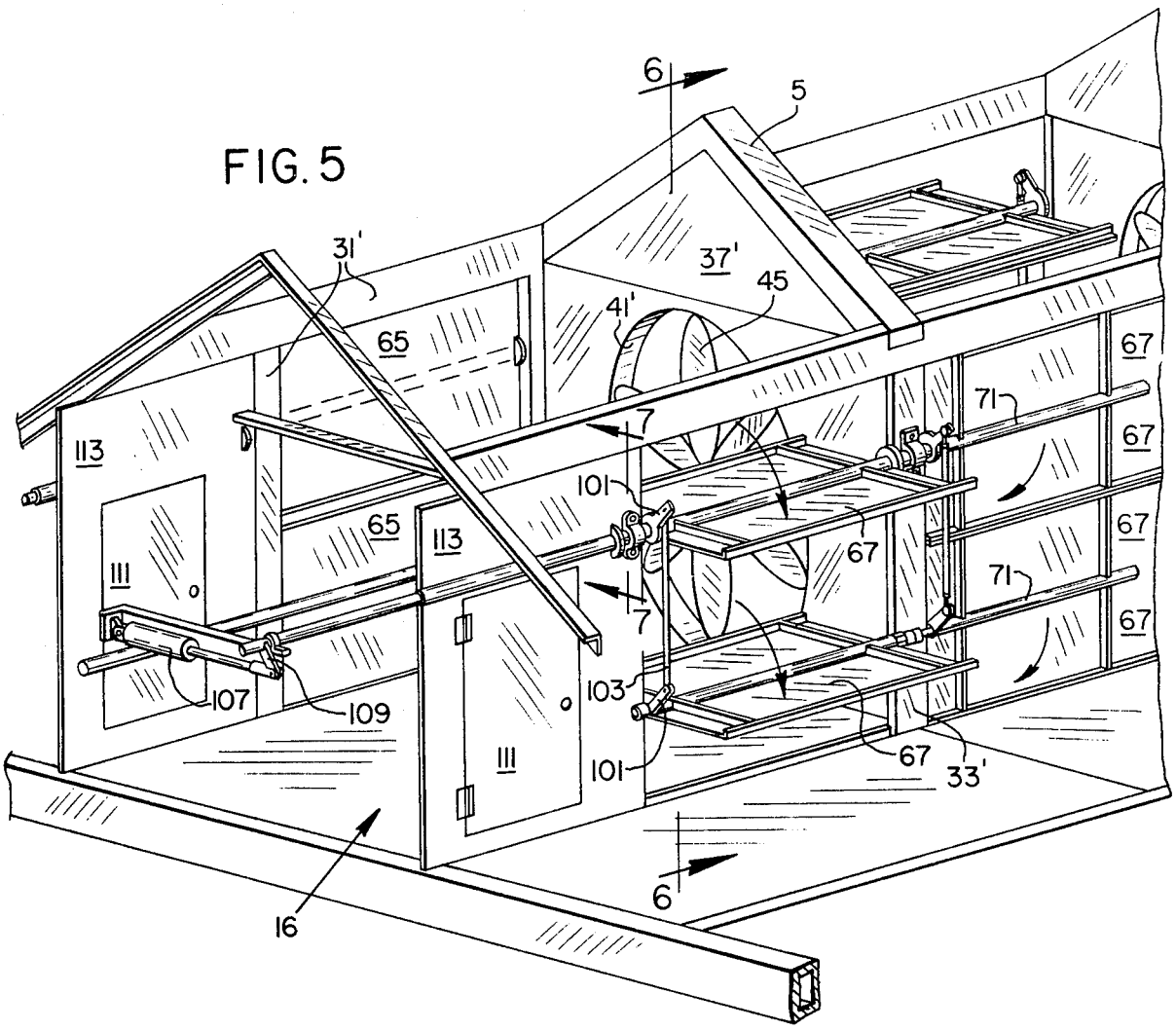

DRY KILN HAVING BIDIRECTIONAL AIR FLOW WITH UNIDIRECTIONAL FAN ROTATION

BACKGROUND OF THE INVENTION

Air circulation control systems for lumber dry kilns, wherein the air fans are all mounted on a common shaft, have generally required that the drive means (motor, steam turbine, etc.) which drives the fan shaft, be reversible so as to enable the flow of drying air to be reversed, thus ensuring a uniform drying process. This also has required that the fan blades be symmetrical, enabling equal air flow in either of the two directions. Reversible fan blades of this type inherently yield a lower efficiency (volume of air moved/power to drive fan) than the standard non-reversible type. Because of stored energy in this system ("flywheel effect"), the reversing process can take a matter of minutes to transpire, allowing the air flow to cease and causing the drying process to be prolonged. This results in a costly, inefficient dry kiln operation.

SUMMARY OF THE INVENTION

The present invention overcomes the above disadvantages by providing fans driven only in one direction, so that the fan blades may be designed for maximum efficiency and power. Air deflecting means are provided for effecting a reversal of the direction of flow of the air through the drying chamber of the kiln. This air reversal arrangement comprises a series of in-tandem compartments with a fan between each pair of adjacent compartments. Adjacent fans have their blades at opposite pitch and the lateral walls of the compartment have air flow ports equipped with air valves. A control arrangement is provided for the air valves so that, in regard to a pair of compartments, when one set of catercornered air valves is open, the other set is closed, and vice versa, to achieve air flow in one direction through the drying chamber of the kiln when the valves are operated one way, and to achieve a reversal of flow, when the valves are operated the other way, all while the fans are rotating in one direction only.

It is an object of the present invention to provide an improved dry kiln to achieve bidirectional flow of the drying air through the drying chamber with unidirectionally driven fans.

Another object of the invention is to provide an improved dry kiln of the above type having a novel arrangement for mounting and controlling the air valves.

A further object of the invention is to provide a kiln of the above character wherein there is a power means for driving the fans which is isolated from the compartments so as to be at a different and more protected environment.

The subject matter which we regard as our invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

In the drawings:

FIG. 4 is a side elevation view of the dry kiln with sidewall removed, taken in the direction of the arrows 4—4 of FIG. 3;

FIG. 5 is an enlarged, fragmentary, perspective view of the improved air circulation control system shown in FIG. 2;

DRY KILN BUILDING

Figure 2:
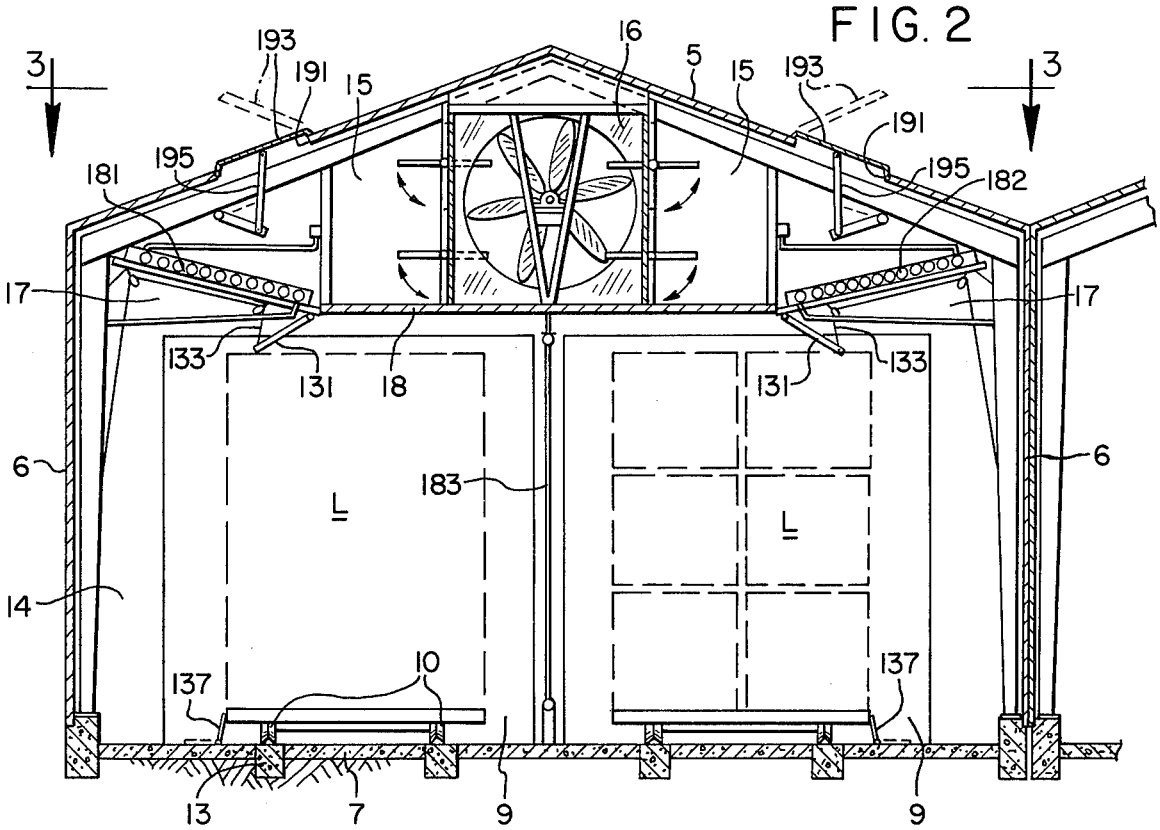
FIG. 2 is an end elevation view of a dry kiln, illustrating one utilization of the improved air circulation control system shown, in principle, in FIG. 1.

Referring now in detail to the drawings, FIG. 2 shows a dry kiln building of the type normally utilized for drying lumber or wood, comprising a roof 5, side walls 6, a floor 7 and a pair of end walls 8 (FIG. 4) having doors 9 (FIG. 2). Means for moving stacked lumber or wood L in and out of the building, through the doors, is shown as wheeled dollies 10, being mounted upon tracks or rails 13.

Utilizing the preferred embodiment of the invention, lumber or wood is moved into the dry kiln building on the dollies, subjected to a drying process, as hereinafter described, and moved back out again upon completion of the process. In the parlance of the art, this process is termed a "batch" type drying process.

The dry kiln building includes a batch charge or drying chamber 14 (FIG. 2), two air circulation control zones 15 located one on each side of a separate air control room 16 (FIGS. 2 and 4). In the particular form of building disclosed, the air circulation zones 15 and the control room 16 are formed in the attic of the building structure, and communicate with the chamber through side gaps 17 formed in a ceiling 18. Thus air, generated in the control room 16, can flow laterally and then downwardly through one of the gaps 17, through the stacks of lumber L in the drying chamber, and then be drawn upwardly through the other gap 17 and return to the control room 16.

AIR CIRCULATION CONTROL SYSTEM

The air control system in the particular form shown in the drawing, is one which is not readily understood from orthographic views, such as FIGS. 2, 3, 4, 6 and 7. It is even somewhat difficult to comprehend with the aid of a fragmentary perspective view like FIG. 5. However, FIG. 1, which is both a perspective view and is schematic clearly discloses certain essential features of the invention. Therefore, the structure will be first explained primarily in connection with FIG. 1, with only incidental reference to FIGS. 2 - 7, whereafter, detailed reference will be made to the latter figures.

Figure 1:
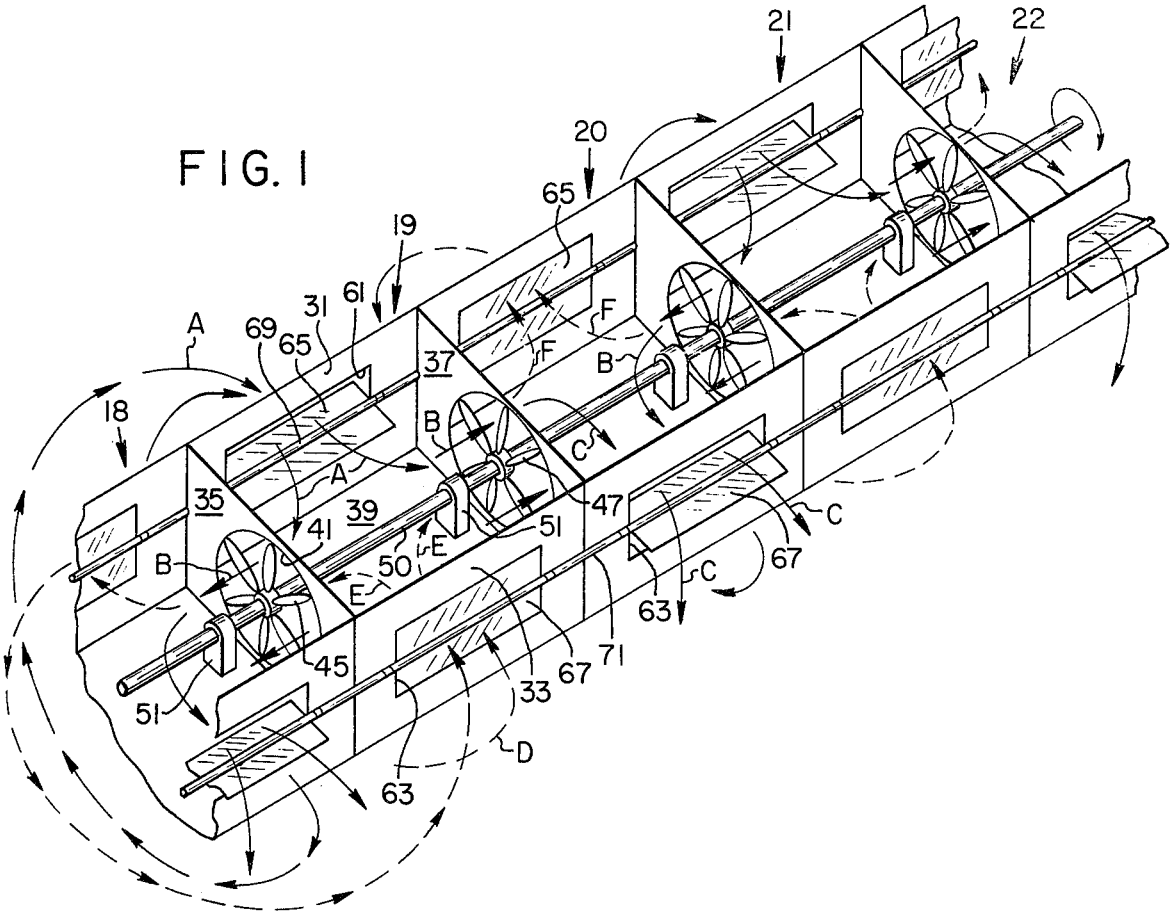
FIG. 1 is a fragmentary, schematic perspective view of an improved air circulation control system forming one embodiment of the invention.
Figure 3:
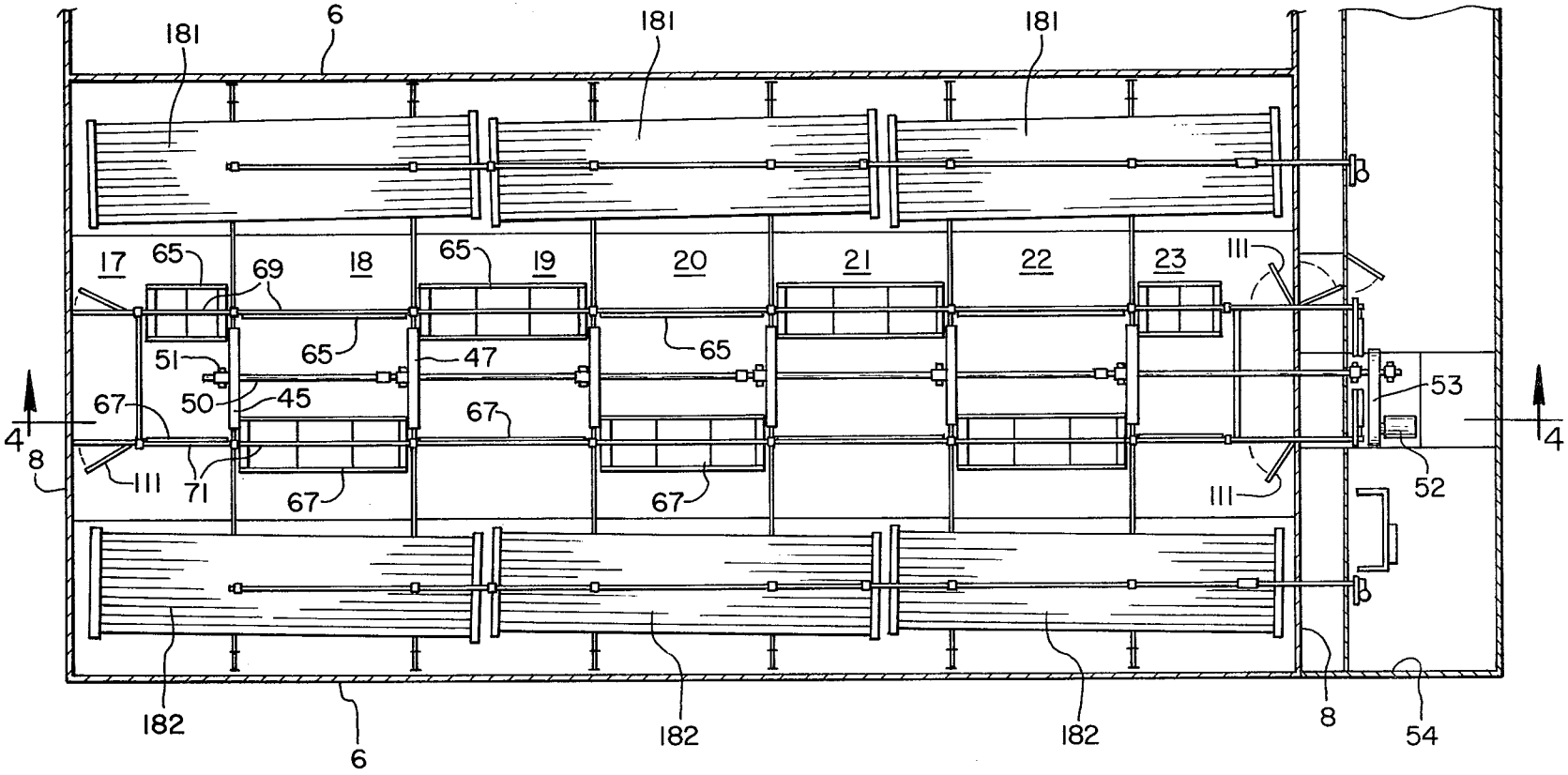
FIG. 3 is a top plan view of the dry kiln with roof removed, taken in the direction of the arrows 3—3 of FIG. 2.

Referring first to FIGS. 1 - 3, the room 16 is divided into seven air controlled compartments, numbered 17 through 23, respectively, only compartments 18 - 22 being shown in FIG. 1.

Referring to FIG. 1, and particularly to compartment 19, it has opposed side walls 31 and 33, opposed end walls 35 and 37, a floor 39 and a top wall or ceiling (not shown) formed by the roof 5 of the building structure.

The end walls are common between adjacent compartments, and each end wall is formed with an opening 41 to receive a fan 45 for wall 35 and a fan 47 for end wall 37. The fans are fixed to a common drive shaft 50 which extends lengthwise of the building and is mounted in bearing units 51 supported by the floor 39. It is driven by a motor 52 (FIG. 3) through a belt 53 or other suitable means. The motor is located in a room 54 isolated from the drying chamber.

Referring to FIG. 1, each of the side walls 31 and 33 is provided with an air control valve. For side wall 31, this includes a flow opening or port 61 formed in the side wall, and for side wall 33, the valve includes a flow opening or port 63. A movable valve member in the form of vane 65 controls the flow through port 61 and a similar vane 67 is provided for opening or port 63. Vane 65 and the similar vanes 65 for the other compartments are mounted on a common control shaft 69 which is pivotally mounted on the side walls 31 of the various compartments.

A control shaft 71, similar to control shaft 69 is provided on the opposite side of the compartments. Each shaft has its vanes fixedly mounted thereon alternately at right angles to one another. However, the relationship of the control shafts to one another is such that vane 65 of each compartment is at 90° to vane 67 so that when vane 65 is opened, as shown in FIG. 1, vane 67 is closed, and vice versa. This means that as respects a pair of adjacent compartments, say compartments 19 and 20, when one set of catercornered vanes is open (65 of 19 and 67 of 20) the other catercornered set is closed (67 of 19 and 65 of 20), and vice versa.

The pitch of alternate fans is opposite to that of the intermediate fans, so that the fan for wall 35 of compartment 19 drives the air to the left as the parts are shown in FIG. 1, whereas the fan for wall 37 drives the air to the right. This means that the fans for compartment 19 mutually cooperate to drive air from the compartment into the adjacent compartments. It further means that the fans in the adjacent compartments, for instance, compartment 20, cooperate to drive the air from the compartment through whichever air valve is open.

Referring to FIG. 1, with the valves for compartments 19 and 20 in the position shown, it is evident that the fans associated with compartment 19 will function to draw air through the port 61 as shown by arrows A and exhaust the air into compartment 20, and also compartment 18, as shown by arrows B. The fans associated with compartment 20 will thereupon function to drive the air out through the port 63 of compartment 20, as shown by the arrows C, whereupon this air will then pass downwardly and through the load of lumber L to be dried and then return to the compartments being drawn upwardly by the fans.

Now, if the control shafts are turned 90° so that the vanes which were previously open are now closed, air will flow as indicated by the lines D through the port 63 for compartment 19, to be driven from that compartment into compartments 18 and 20, arrows E, and then exhausted as shown by arrow F through the ports 61 of compartments 20 and 18. The air will then be directed downwardly through the lumber to be dried and drawn upwardly to return to the open vanes.

It is evident from the above that although the fans are rotating in one direction only and are never reversed, the compartments plus their alternately operated air valves, function to cause the air to circulate in one direction when the vanes are in one position and in the opposite direction when the vanes are in their second positions.

FIGS. 2 - 7

As previously mentioned, FIG. 1 is a schematic view. Thus, its disclosure is abstracted and simplified from that shown in the other figures. To avoid confusion, when reference is made to FIGS. 2 - 7, if there is a difference between the structure shown in FIG. 1 and that shown in FIGS. 2 - 7, the prime mark will be used to indicate a similar part in the latter figures.

FIGS. 4 and 5 shown that the lateral or side walls of the compartments 17 - 23 are essentially in the form of frames 31' and 33' rather than panels, as shown in FIG. 1, and that the ports formed in these side walls constitute a substantial portion of the area of such side walls. Such ports, in face, are large enough to accommodate a pair of vanes 67 for the side walls 33' and a pair of vanes 65 for the side walls 31'.

There is also a control shaft 69 for each linear set of vanes 65 and a control shaft 71 for each linear set of vanes 67 (FIG. 5). Each pair of control shafts is operated similarly. FIG. 5 shows that control shafts 71 are connected together for in unison movement. This is accomplished by providing a crank 101 on each of the shafts and connecting these by a drive link 103. The upper control shaft 71 is operated by a piston and cylinder unit 107 through the medium of a crank 109. When the piston and cylinder unit is actuated one way, the vanes 67 of the alternate compartments will be opened, whereas the vanes of the intermediate compartments will be closed, and vice versa when the piston and cylinder unit is operated the opposite way.

Figure 6:
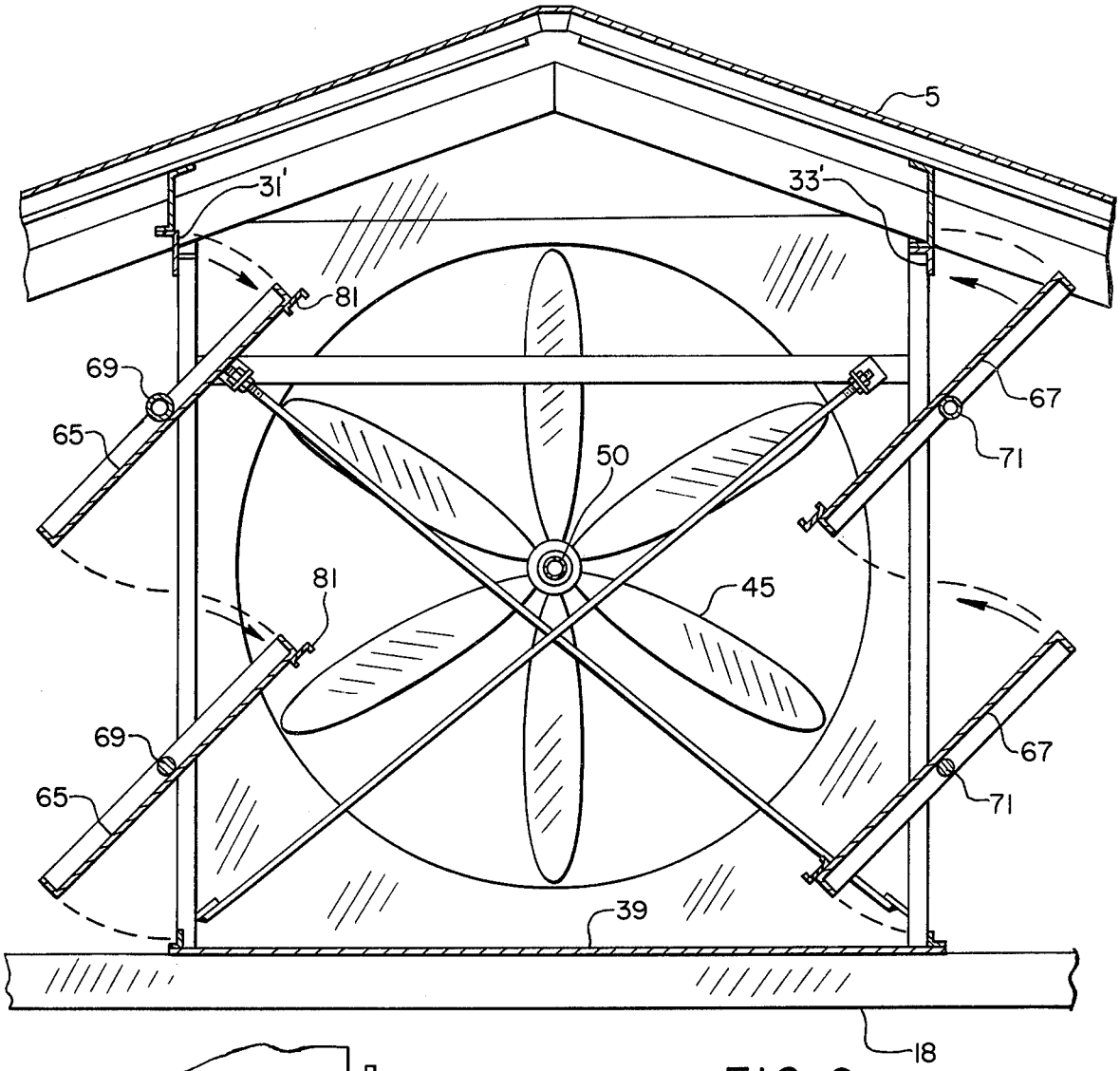
FIG. 6 is an enlarged end elevation view of the improved air circulation control system taken along line 6—6 of FIG. 5.
Figure 7:
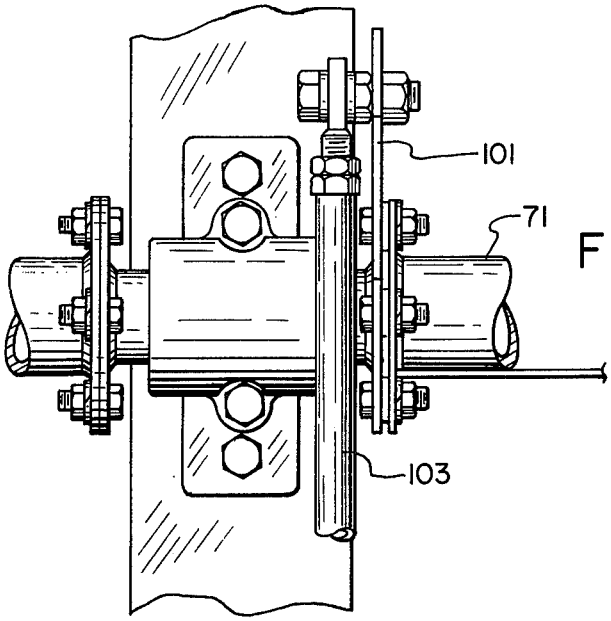
FIG. 7 is an enlarged elevation view of a control shaft support and lever arm assembly taken along line 7—7 of FIG. 5.

FIG. 6 shows that each of the vanes 65 has a stop 81, the upper stop 81 adapted to come into contact with the upper edge of the associated side wall 31', whereas the lower vane will have its stop brought into engagement with the lower edge of the upper vane 65. Thus, the stops 81 will positively locate the vanes in their fully closed position when they are moved toward their closed positions.

FIG. 5 also shows that the end walls 37' have peaked portions to fit the contour of the roof 5. This figure also shows that the openings 41 in the end walls are preferably defined by shrouds 41' around the fans 45.

FIG. 5 shows a door 111 may be provided in either side of the end panel walls 113 of the air controlled room 16 to provide access to the interior of the control room.

FIG. 2 shows that baffles are provided to better direct the flow of air through the lumber stacks L, rather than around such stacks. To this end, an upper lateral baffle 131 is hinged to each of the side edges of the ceiling 18. Suitable controls in the way of a pulley arrangement 133 is utilized to raise and lower the baffles. A similar set of floor baffles 137 is provided to engage the lower portions of the stacks. Thus, the upper baffles 131 prevent air from bypassing the stacks L at the upper portion of the stacks, whereas the baffles 137 preclude bypassing at the lower portion of the stacks. End baffles 139 (FIG. 4) may also be provided.

FIG. 2 shows that means are provided for heating the air in the dry kiln building. These means are shown as conventional banks of heating coils 181 and 182 at the gaps 17 of the ceiling 18. There are also heating coil means 183 at the center of the building. All these coils are connected by suitable piping to a source of steam (not shown). Equivalent heating means could be substituted for that shown.

A humidity control system of standard design is also provided for the building to control the humidity. This system includes vents 191 in the roof 5, optionally selectively closed by doors 193, the latter being operated by suitable controls indicated generally at 195. A portion of the air will be exhausted during the circulation thereof and additional air drawn into the building to gradually replace air which has become saturated with moisture.

What is claimed is:

1. In a dry kiln having a drying chamber, means defining plural, in-tandem, air control compartments for controlling the flow of air to said drying chamber, a fan mounted between each pair of compartments, means for rotating said fans in one direction only, adjacent fans having blades of opposite pitch so that the fans drive air from certain compartments into adjacent compartments, said compartments each having a pair of air flow ports for ingress and egress of air, a valve for each port, and control means for opening the valves of one of a pair of flow ports while closing the other, and vice versa to achieve directional control of the air entering and leaving said compartments.

2. A dry kiln as recited in claim 1, wherein said control means alternates the opening and closing of the valves of adjacent compartments in a manner to achieve reversal of the direction of flow of air through said drying chamber, even though said fans are driven in only one direction.

3. A dry kiln as recited in claim 1, wherein each compartment is defined by end walls in which said fans are mounted, and side walls, each of which has at least one of said flow ports, said control means functioning, in regard to each pair of compartments, to open one set of catercornered related valves of said pair of compartments while closing the other set to achieve air flow in one direction, or to close said one set and to open the other to reverse the direction of flow.

4. A dry kiln as recited in claim 3, in which the fans are mounted on a common fan shaft, and said rotating means rotates said shaft in one direction only.

5. A dry kiln as recited in claim 3 in which there is an actuating shaft at each side of the compartments, each shaft being common to the associated valves which are alternated 90° from one another.

* * * * *